US005368537A

United States Patent [19]

Felice

[11] Patent Number: 5,368,537

[45] Date of Patent: Nov. 29, 1994

[54] EXERCISE APPARATUS

[75] Inventor: Louis Felice, Chicago, Ill.

[73] Assignee: Coin Acceptors, Inc., St. Louis, Mo.

[21] Appl. No.: 691,226

[22] Filed: Apr. 25, 1991

[51] Int. Cl.[5] ..... A63B 23/02

[52] U.S. Cl. ..... 482/140

[58] Field of Search ..... 482/140, 142, 49; 280/18, 18.1; 294/144, 150, 152; 211/61, 117; 604/DIG. 12

[56] References Cited

U.S. PATENT DOCUMENTS

| | | | |
|---|---|---|---|
| 1,709,928 | 4/1929 | Whitney | 294/144 |
| 1,721,709 | 7/1929 | Odell | 482/142 |
| 4,093,211 | 6/1978 | Hughes et al. | 482/49 |
| 4,752,067 | 6/1988 | Colonello | 482/140 |
| 5,078,309 | 1/1992 | Hull et al. | 211/64 |

OTHER PUBLICATIONS

Sled-Doo Ad, "ZigZaggers" Model 5016AP Mar. 1969.

*Primary Examiner*—Randall L. Green
*Assistant Examiner*—Rob Clarke
*Attorney, Agent, or Firm*—Haverstock, Garrett & Roberts

[57] ABSTRACT

An apparatus for making abdominal exercises such as sit-ups and the like easier to perform by enabling a person to use the upper body and arms in varying amounts to assist the abdominal muscles in completing the exercise motions, the apparatus comprising a substantially planar base member on which a person may be positioned and at least one and preferably a plurality of pairs of opposing handgrips attached to opposite sides of the base member and extending upwardly therefrom at an angular relation thereto, the person being able to select the handgrips which are most comfortable and enable use of the upper body and arms to a desired extent to assist the abdominal muscles in raising and lowering the upper body portion or legs, the base member being positionable on any relatively flat surface and being adapted so as to not rock, pivot or otherwise move thereon during use and the pairs of handgrips being progressively farther apart toward one end of the base member so as to not interfere with access to the other pairs of handgrips. The apparatus preferably also including an optional pad for the top surface of the base member to provide support for the lower back of a person using the apparatus and floor engaging means to prevent the apparatus from sliding on a floor or other surface during use.

2 Claims, 2 Drawing Sheets

EXERCISE APPARATUS

The present invention relates generally to devices for making exercise easier, and more particularly, to a device for making abdominal exercises such as sit-ups and the like easier to perform by enabling a person to use his or her upper body and arms in varying amounts to assist the abdominal muscles in completing the exercise motions. The present device is usable for such purposes as maintaining muscle tone and fitness and provides such benefits as enabling a person to complete a greater number of exercise repetitions and perform exercises that they may find difficult or be unable to do without assistance. The present device includes a platform or base member which remains stationary and does not rock or pivot during use and which may include optional padding for support and added cushioning and comfort. The present device also includes a plurality of handles or handgrips which are upstanding, easy to grasp and which enable a user's arms to be located comfortably next to his or her sides during exercise. The present device is well suited for use by persons of any physical condition and is especially well suited for use by persons just beginning an exercise routine.

BACKGROUND OF THE INVENTION

Abdominal exercises are considered to be some of the most difficult and rigorous of exercises. Many persons find themselves in need of developing and toning their abdominal muscles for such purposes as eliminating large stomachs and waists, and for correcting various posture and back problems. However, many such persons find abdominal exercises to be overly difficult or impossible to perform and quickly become discouraged from exercising. Other persons in better physical condition desire to be able to perform more repetitions of particular abdominal exercises for such purposes as increasing endurance, stamina and including abdominal exercises in aerobic fitness routines. Numerous devices for use in exercising the abdominal muscles are known in the art. One such device is disclosed in U.S. Pat. No. 4,752,067 which shows an exercise device having a contoured shape for receiving a user's pelvic and lumbar regions. slots therethrough forming handles and a rocker portion on the underside on which the device is balanced and pivoted during use. Such device is limited however in that the contoured portions may not be suitably sized and shaped for receiving a particular user's anatomy and it may be difficult for some persons, especially those just beginning an exercise routine, to balance and pivot the device on the rocker portion. Another shortcoming of such device is that the handles may be uncomfortable for some users to grasp and may place the user's arms in uncomfortable positions. No known device for use in exercising the abdominal muscles provides the ease of use and capability for varying the degree of assistance from the upper body and arms to the abdominal muscles that are provided by the present invention.

SUMMARY OF THE INVENTION

The present invention overcomes many of the limitations and shortcomings associated with known prior art devices and teaches the construction and operation of an improved device for making abdominal exercises easier and less strenuous. The present device may be used for any number of abdominal exercises and is especially useful for sit-ups, also known as abdominal curls, and other exercises wherein persons pivot or bend at their waist to raise and lower portions of their body between an upright and a horizontal position. Important among the novel features of the present device is a base member or platform construction which is positionable on any substantially flat surface such as a floor, remains relatively stationary and stable thereon and does not rock or pivot during use. Also important are a plurality of handles or handgrips which are located adjacent to opposite sides of the base member and extend upwardly therefrom. The handgrips are positioned and oriented so as to be easily and comfortably grasped by a user and enable the user's arms to be comfortably positioned adjacent to his or her sides and not extending outwardly in wing-like fashion as with some known exercise devices. The positions of the handgrips also enable the user to select between different possible arm bends as desired for comfort and to assist in the exercise.

An important advantage of the present device is that it provides a user the flexibility to use as much or as little upper body and arm assistance as desired to enable controlling the stress and exertion of the abdominal muscles during exercise. Flexibility to control the exertion of the abdominal muscles enables users to complete a greater number of exercise repetitions than possible using the abdominal muscles alone and to perform exercises that would be too strenuous without such assistance for such purposes as developing and maintaining muscle tone, strength and fitness condition and for using abdominal exercises as part of aerobic fitness routines and the like. As users develop and improve their abdominal muscles, they may decrease the reliance on the upper body and arms and place more emphasis on the abdominal muscles to perform more strenuous exercises and expand their exercise routine for greater development.

The present base member generally comprises a planar structure sized and shaped to receive and support a user's lower back and pelvic regions. The base member is locatable on any relatively flat, horizontal surface such as the floor of a home, gymnasium, a playground or any other suitable surface. A user may sit or lay on the top surface of the base member, select a pair of handgrips and perform a variety of exercises. Importantly, during the exercises the base member remains stationary and does not rock, pivot or otherwise move in any significant manner so as to be easy to use and not require balancing, dexterity or body synchronization during use. The base member is preferably of rigid construction and remains substantially planar during use and does not fold or bend. For comfort, the base member also preferably includes an optional pad on the top surface thereof.

The plurality of handles or handgrips are attached to opposite sides of the base member and are arranged in several pairs to provide users a selection of locations to grasp. Importantly, each handgrip extends upwardly from the base member and is preferably oriented at an acute angle toward the front or forward end of the device from which the user's legs will extend so as to be more effectively and comfortably grasped during the full range of bending and pivoting movements required during abdominal exercises. Also importantly, the handgrips comprising each pair are located progressively farther apart toward the forward end of the device. This progressive spacing enables a user to more comfortably grasp more forwardly located handgrips with his or her arms positioned outside the more rearward hangrips without obstruction or interference from the more rearwardly located handgrips.

In use, a person is able to quickly and easily position her or himself on the base member, grasp a pair of handgrips and use the upper body and arms to any desired degree to assist the abdominal muscles in performing a wide variety of abdominal and other exercises. The user may choose to provide a great deal of assistance to the abdominal muscles, for instance when just beginning an exercise routine or learning a new or more difficult exercise, and may provide less assistance as the abdominal muscles become stronger and better conditioned. In this way, by using the present device a user such as a beginner or the like may control the exertion and development of the abdominal muscles to gain confidence and encouragement from exercise, and a more physically fit person such as an athlete may more closely tailor the abdominal workout for achieving specific muscular development and tone.

It is therefore a principle object of the present invention to teach the construction of an improved apparatus for making abdominal exercises such as sit-ups more meaningful and more in accord with a person's physical condition.

Another object is to provide an exercise device which reduces the exertion and amount of work which must be performed by the abdominal muscles in performing abdominal exercises.

Another object is to provide an apparatus for exercising the abdominal muscles which enables a user to use his or her upper body and arms to assist the abdominal muscles.

Another object is to provide an exercise apparatus enabling a user to vary the amount of assistance provided by the upper body and arms to the abdominal muscles.

Another object is to provide an exercise apparatus which remains flat on a floor or other surface and does not rock or pivot during use.

Another object is to provide an exercise device having a plurality of upstanding handgrips positioned to enable a user to position his or her arms adjacent to his or her sides and comfortably grasp the handgrips while exercising.

Another object is to make it possible for a beginner, person out of condition, or a person needing to do abdominal exercises for therapy or other purposes to do more sit-ups than would otherwise be possible because of added help provided by the upper body and arms.

Another object is to provide an apparatus for use in exercising the abdominal muscles which is comfortable, convenient and easy to use.

These and other objects of the present device will become apparent to those skilled in the art after considering the following detailed specification in conjunction with the accompanying drawings wherein:

DETAILED DESCRIPTION OF THE PREFERRED EMBODIMENT

Figure 1:
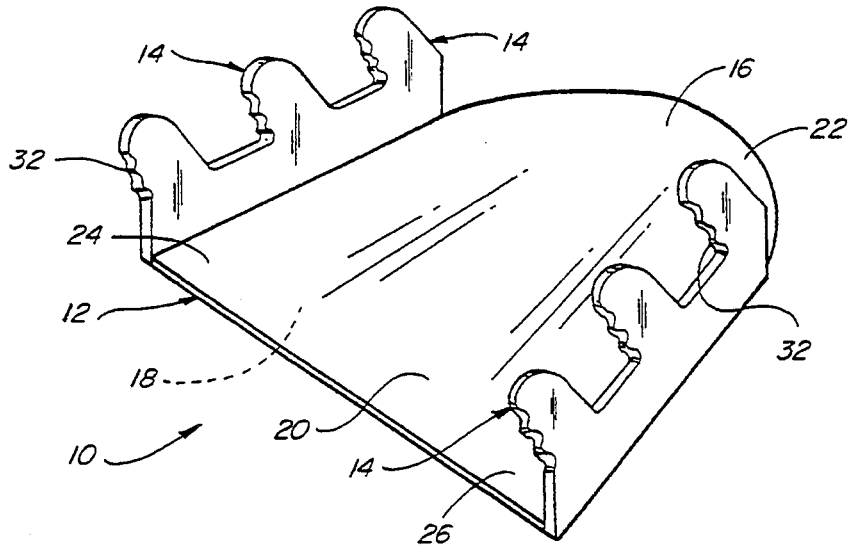
FIG. 1 is a perspective view of an exercise apparatus constructed according to the teachings of the present invention, the exercise apparatus including a base member and a plurality of upwardly extending handgrips.

Referring to the drawings more particularly by reference numbers, wherein like numerals refer to like parts, number 10 in FIG. 1 indentifies an exercise device constructed according to the teachings of the present invention. The device 10 includes a base member 12 and a plurality of handles or handgrips 14 positioned in spaced, opposed relation adjacent to opposite sides of base member 12. The base member 12 is a substantially planar structure having a top surface 16 on which a user may be positioned to exercise and an underside or bottom surface 18 which is locatable on a floor or any other relatively flat surface. The base member 12 is preferably constructed of a substantially rigid or semi-rigid material such as wood, plastic or other suitable substance such that the base member does not significantly bend, flex or otherwise deform when a person is positioned thereon and using the handgrips 14 to help the abdominal muscles raise and lower the upper body or legs. The planar shape and rigidity of base member 12 are also important to enable the base member to remain flat on a floor or other surface during use such that a user is able to exercise without having to rock or pivot the device or perform other movements requiring dexterity, balance or coordination in addition to the exercise motions.

Figure 2:
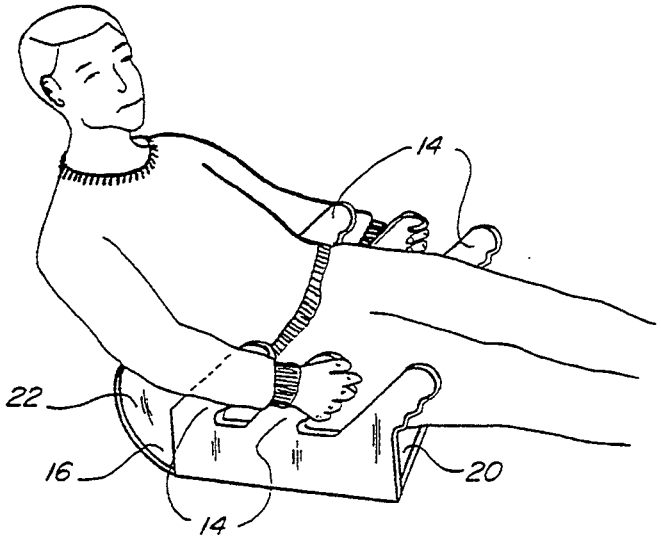
FIG. 2 is another perspective view of the exercise apparatus of FIG. 1 showing a person positioned on the base member and grasping a pair of handgrips.
Figure 3:
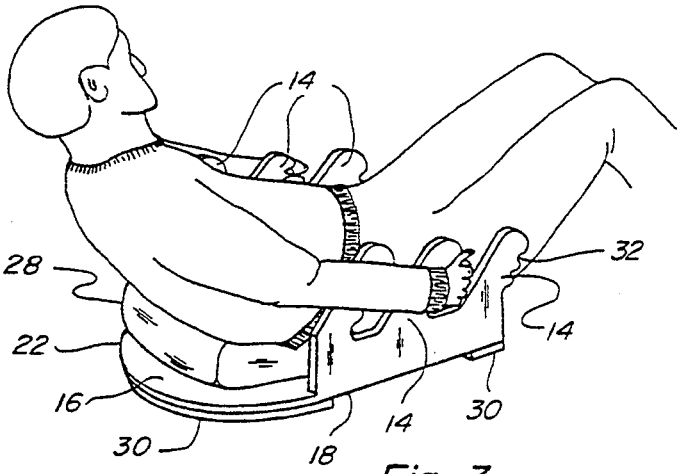
FIG. 3 is another perspective view of the exercise apparatus of FIG. 1 showing an optional pad located beneath the lower back portion of a person positioned on the base member and optional rubber pads on the bottom surface thereof.

The top surface 16 of base member 12 is sized and shaped to receive the pelvic and lumbar regions of a person located thereon in a wide variety of positions. The top surface 16 includes a front or forward end portion 20 toward which the handgrips 14 are preferably slanted or angularly oriented, a rear end portion 22 located opposite the front end 20 and a pair of opposing side portions 24 and 26 which extend the length of the base member from front end 20 to rear end 22 and adjacent to which the handgrips 14 are located. To perform sit-ups and other abdominal curl-type exercises, a user is positioned on the top surface 16 with the legs adjacent to and extending outwardly from the front end 20 such that the handgrips 14 are located at the user's sides and within comfortable reach throughout the range of motion for a desired exercise, as shown in FIG. 2. The rear end 22 of the base member extends beyond the rearmost handgrips 14 a sufficient amount so as to be located below the lower back or lumbar region of a person performing sit-ups when in a prone or semi-prone position. To provide support for the user's lower back and for added comfort, an optional resilient cushion or pad 28 may be located on the top surface 16, as shown in FIG. 3. The pad 28 may be sized and shaped to cover all or part of the top surface 16, may be of any desired thickness and resiliency and may be loosely positioned on the top surface or attached thereto using any suitable means such as snaps, VELCRO fasteners and the like. The bottom surface 18 may also optionally include floor engaging means such as rubber pads 30 and the like for preventing sliding and other movement of the device during use.

Figure 6:
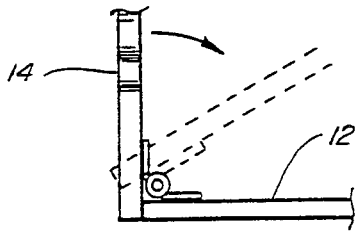
FIG. 6 is an enlarged fragmentary front elevational view of the apparatus of FIG. 1 showing alternative hinged attachment of the handgrips to the base member, the handgrips being shown in an upright position in solid lines and at an angular orientation in phantom lines.
Figure 5:
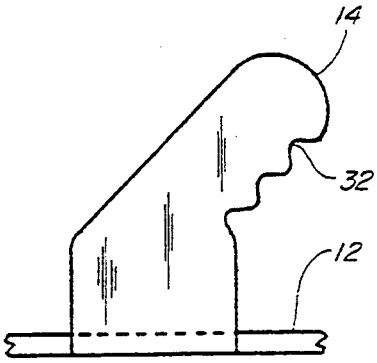
FIG. 5 is an enlarged fragmentary side elevational view of the apparatus of FIG. 1 showing an alternative embodiment of a handgrip.
Figure 4:
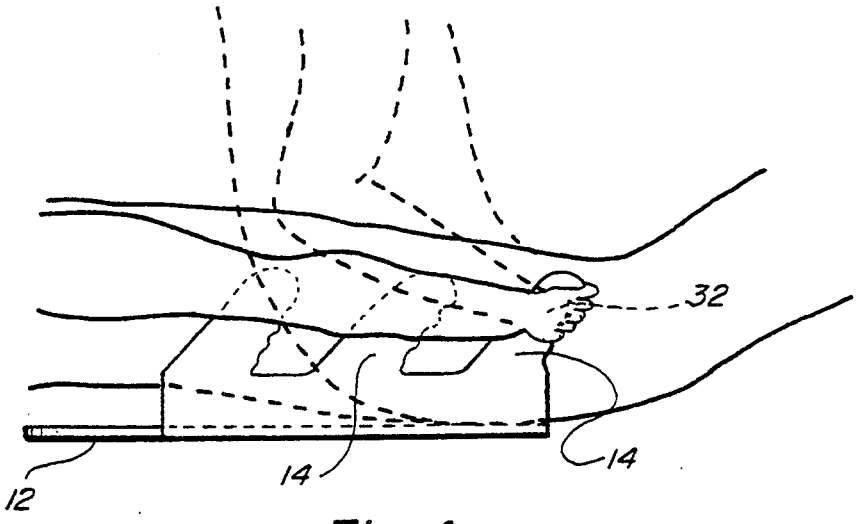
FIG. 4 is an enlarged side elevational view of the apparatus of FIG. 1 showing a portion of a human form positioned on the base member, the human form shown in a prone position in solid lines and in an upright sitting position in phantom lines.

The handgrips 14 located adjacent to opposing sides 24 and 26 are of rigid construction, have an elongated shape and extend upwardly relative to top surface 16 at an acute angle toward front end 20. A contoured grip portion 32 formed by a plurality of spaced indentations or grooves is located on the forward or underside portion of each handgrip to enable users to more comfortably and securely grasp the handgrips. The rigid construction, upwardly extending angular orientation and contoured grip portion 32 of the handgrips 14 enable a user positioned on top surface 16 to easily and comfortably grasp the handgrips 14 through the full range of motion for performing a variety of abdominal exercises, including a range from a prone to a sitting position for exercises such as sit-ups as shown in FIG. 4. During such full range of movements the user is able to use the upper body and arms to any desired degree to assist the abdominal muscles in raising and lowering the upper body or legs and for performing other desired exercise movements. The user's arms are able to remain comfortably positioned close to the user's sides and elevated above the floor and not extending outwardly in wing-like fashion. The handgrips 14 adjacent to each side of the base member 12 preferably form an integral member which is attached to the base member 12 adjacent to the sides 24 and 26 using any suitable means. The handgrips 14 can alternatively comprise individual members such as shown in FIG. 5. The handgrips 14 can be rigidly attached to the base member 12 as shown in FIG. 1–3, or alternatively, detachably, or hingedly attached thereto for convenience and ease of storing and transporting the device, as shown in FIG. 6.

Figure 7:
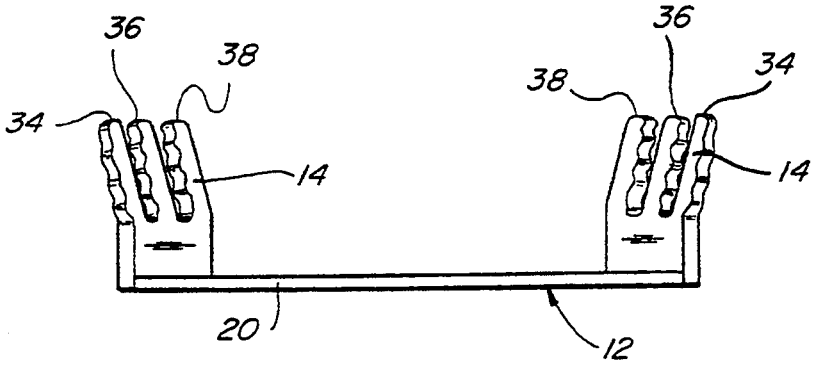
FIG. 7 is a front elevational view of the apparatus of FIG. 1 showing the spacing between handgrips.
Figure 8:
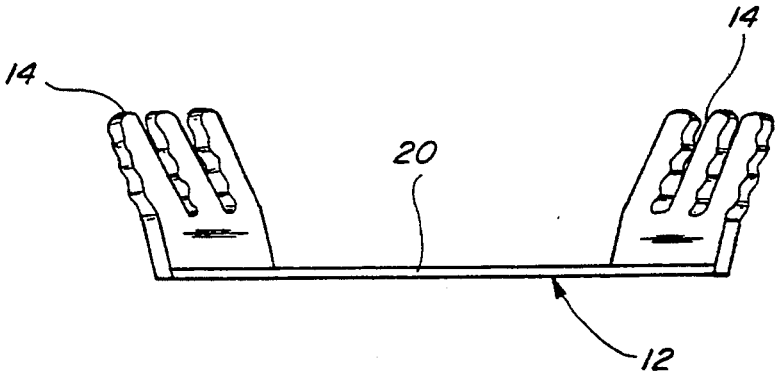
FIG. 8 is a front elevational view of the apparatus of FIG. 1 showing the handgrips in an alternative outwardly extending angular orientation.

The handgrips 14 are arranged in three pairs located progressively farther away from the front edge 20 of the base member. The three pairs include a forward pair 34 located closest to front end 20, an intermediate pair 36 and rear pair 38. Importantly, the handgrips 14 comprising forward pair 34 are spaced farther apart than the intermediate pair 36, both of which pairs are spaced farther apart than the rear pair 38, as shown in FIG. 7. Such different spacing is important as it enables a user to select and comfortably grasp either of the forward or intermediate pairs 34 or 36 with the arms being located adjacent to the outside of the more rearwardly located handgrips 38 without interference or obstruction therefrom. The handgrips 14 are shown in FIGS. 1–7 as being substantially vertically oriented when viewed from the front end of the device, but alternatively can also be oriented in a variety of other ways, for instance angled outwardly, as shown in FIG. 8.

The three pairs of handgrips 34, 36 and 38 of the preferred embodiment provide a user with a versatile selection of locations for grasping the present device 10 and enable the use of the upper body and arms to assist the abdominal muscles to any desired degree. For instance, for sit-ups or other abdominal curl-type exercises wherein a person's upper body and/or legs are pivoted or rotated about the waist, the person may grasp the pair of handgrips 34, 36 or 38 which provides the desired amount of arm bend and leverage to assist the abdominal muscles to the desired extent. The user can select forward pair 34 such that the arms may be straighter and provide more leverage for greater assistance, or alternatively, intermediate pair 36 or rear pair 38 for more arm bend and less assistance, as desired. The selection of handgrips is useful for a variety of purposes in an exercise routine or program, for instance, to enable more gradually strengthening the abdominal muscles over a period of time such as may be necessary for beginning exercisers or for those exercising for therapeutic reasons, to enable performing more exercise repetitions than possible without the device and for use to control the exertion of particular muscles during a workout session.

Thus there has been shown and described preferred embodiments of an exercise apparatus, which apparatus fulfills all of the objects and advantages sought therefor. Many changes, modifications, variations and other uses and applications of the present exercise apparatus will, however, become apparent to those skilled in the art after considering the specification and the accompanying drawings. All such changes, modifications, variations and other uses and applications which do not depart from the spirit and scope of the invention are deemed to be covered by the invention with is limited only by the claims which follow.

What is claimed is:

1. An exercise apparatus comprising a substantially planar base member having opposite end portions and opposite sides extending between said opposite end portions, a top surface adapted to receive and support portions of the pelvic and lower back regions of a person positioned thereon and an underside located opposite said top surface for positioning on a relatively flat surface such as a floor, and a plurality of three or more spaced pairs of handgrips attached to said base member adjacent to said opposite sides of the base member, said pairs of handgrips being progressively farther apart toward one end of said base member, said handgrips being adapted to be grasped by a person positioned on said top surface as an aid in raising and lowering the upper body portion during sit-up exercises.

2. In an exercise apparatus on which a person performs abdominal exercises the improvement comprising a platform of substantially planar construction of relatively rigid material, the platform having opposite end portions and opposite sides extending between the opposite end portions, a plurality of handles being arranged in opposed pairs adjacent the opposite sides of the platform, each of said pairs of handles including a handle attached to each opposite side of the platform, each of said handles extending upwardly from said platform and oriented at an acute angle relatively thereto such that a person positioned on said platform is able to grasp a desired pair of said handles and use the arms to assist in performing abdominal exercise in raising and lowering the upper portion of the body, one of the pair of handles being closer together than another pair.

* * * * *